US008596968B2

(12) United States Patent
Emmerson

(10) Patent No.: US 8,596,968 B2
(45) Date of Patent: Dec. 3, 2013

(54) DIFFUSER FOR A COMPRESSOR

(75) Inventor: Calvin W. Emmerson, San Diego, CA (US)

(73) Assignee: Rolls-Royce North American Technologies, Inc., Indianapolis, IN (US)

( * ) Notice: Subject to any disclaimer, the term of this patent is extended or adjusted under 35 U.S.C. 154(b) by 841 days.

(21) Appl. No.: 12/620,897

(22) Filed: Nov. 18, 2009

(65) Prior Publication Data

US 2010/0166552 A1 Jul. 1, 2010

Related U.S. Application Data

(60) Provisional application No. 61/204,062, filed on Dec. 31, 2008.

(51) Int. Cl.
*F04D 29/44* (2006.01)

(52) U.S. Cl.
USPC ..... 415/208.3; 415/211.1; 415/211.2; 416/176

(58) Field of Classification Search
USPC ..... 415/208.1, 208.2, 208.3, 211.1, 211.2; 416/176; 29/889, 889.22, 889.4, 29/888.024
See application file for complete search history.

(56) References Cited

U.S. PATENT DOCUMENTS

| | | | | |
|---|---|---|---|---|
| 3,333,762 | A | 8/1967 | Vrana | |
| 3,625,630 | A | 12/1971 | Soo | |
| 3,759,627 | A | 9/1973 | Ehlinger | |
| 3,860,360 | A * | 1/1975 | Yu | 415/208.3 |
| 3,997,281 | A * | 12/1976 | Atkinson | 415/207 |
| 4,626,168 | A | 12/1986 | Osborne et al. | |
| 4,900,225 | A | 2/1990 | Wulf et al. | |
| 5,145,317 | A | 9/1992 | Brasz | |
| 5,320,489 | A * | 6/1994 | McKenna | 415/208.3 |
| 6,123,506 | A | 9/2000 | Brand et al. | |
| 6,193,463 | B1 * | 2/2001 | Adeff et al. | 415/196 |
| 6,203,275 | B1 | 3/2001 | Kobayashi et al. | |
| 6,280,139 | B1 * | 8/2001 | Romani et al. | 415/207 |
| 6,537,028 | B1 | 3/2003 | Izumi et al. | |
| 6,589,015 | B1 | 7/2003 | Roberts et al. | |
| 6,695,579 | B2 * | 2/2004 | Meng | 415/208.3 |
| 6,699,008 | B2 | 3/2004 | Japikse | |
| 2003/0059301 | A1 | 3/2003 | Izumi et al. | |
| 2005/0226722 | A1 | 10/2005 | Noorkami | |
| 2005/0271500 | A1 | 12/2005 | Lawlor et al. | |
| 2006/0062665 | A1 | 3/2006 | McAuliffe et al. | |
| 2006/0104809 | A1 | 5/2006 | Fish et al. | |
| 2006/0153671 | A1 | 7/2006 | Hustvedt et al. | |
| 2010/0166552 | A1 * | 7/2010 | Emmerson | 415/208.3 |

FOREIGN PATENT DOCUMENTS

EP 733807 A1 * 9/1996

* cited by examiner

*Primary Examiner* — Edward Look
*Assistant Examiner* — Christopher R Legendre
(74) *Attorney, Agent, or Firm* — Krieg DeVault LLP

(57) ABSTRACT

A diffuser is provided having a number of diffuser channels defined by a top wall, bottom wall, and two sidewalls. The sidewalls can be constructed according to an involute of a circle which provides constant interwall distance between the sidewalls along the length of the diffuser channel. The top and bottom walls, however, diverge from one another along the length of the diffuser channel to provide a desired diffusion.

21 Claims, 4 Drawing Sheets

DIFFUSER FOR A COMPRESSOR

CROSS REFERENCE TO RELATED APPLICATIONS

The present application claims the benefit of U.S. Provisional Patent Application 61/204,062, filed Dec. 31, 2008, and is incorporated herein by reference.

FIELD OF THE INVENTION

The present invention generally relates to compressor diffusers, and more particularly, but not exclusively, to diffusers for centrifugal compressors.

BACKGROUND

Diffusing compressed airflow in novel ways remains an area of interest. Some existing systems have various shortcomings relative to certain applications. Accordingly, there remains a need for further contributions in this area of technology.

SUMMARY

One embodiment of the present invention is a unique compressor diffuser. Other embodiments include apparatuses, systems, devices, hardware, methods, and combinations for diffusing flow from a compressor. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
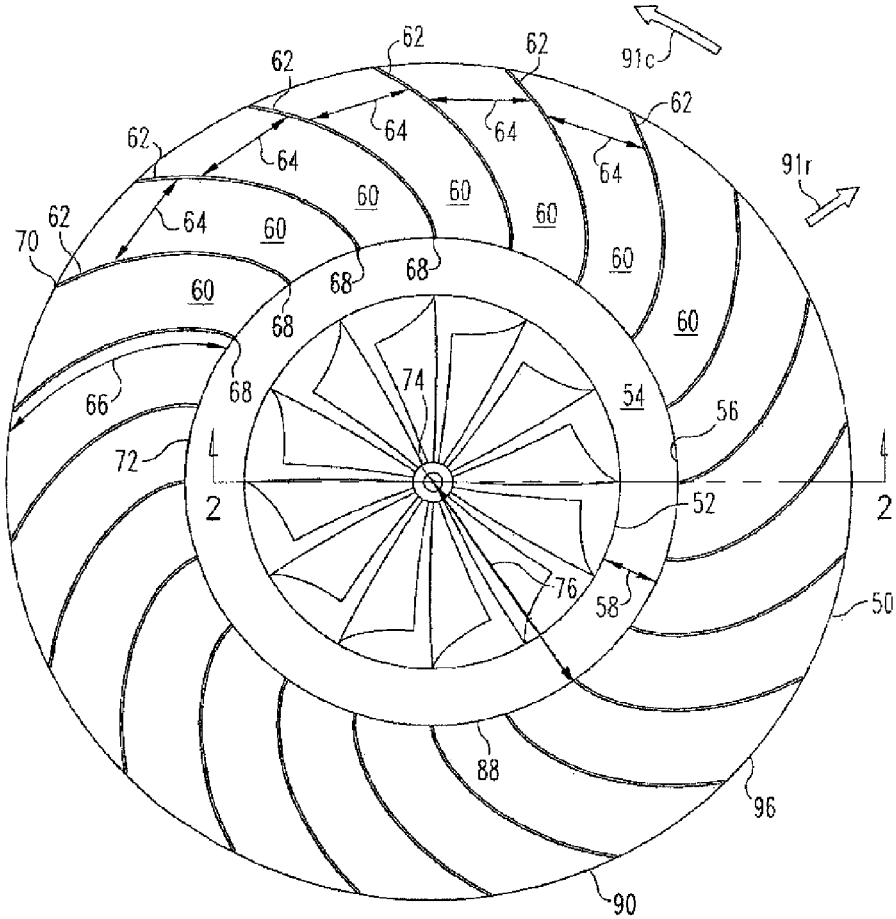
FIG. 1 is a top view of a compressor and diffuser.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

One aspect of the present application includes a diffuser positioned downstream of a centrifugal compressor. The diffuser includes a number of diffuser channels having two sidewalls and a top and bottom wall. The two sidewalls are defined by an involute of a circle, which may be described as a path traced out by a point on a line that rolls around a circle. In one form the involute can be defined by the parametric Cartesian equations: $x=a(\cos t(t)+t \sin(t))$; $y=a(\sin(t)-t \cos(t))$ where x and y describe the Cartesian coordinates of the involute, a is a radius of a starting circle, and t is the free parameter. One property of involutes of a circle provides that the distance between two adjacent involutes drawn from the same starting circle maintain a constant distance along the length of the involutes. Thus, the sidewalls defined by the involutes maintain a constant interwall distance along the length of the diffuser channel. The top and bottom walls of the diffuser channel, on the other hand, diverge from one another along the length of the channel. Therefore, since the interwall distance remains constant, the diffusion through the diffuser channel is provided by the divergence of the top and bottom wall.

With reference to FIG. 1, a top view of a diffuser 50 is positioned around, and thus downstream, of a centrifugal compressor 52. In one form, a vaneless space 54 is disposed between the diffuser 50 and centrifugal compressor 52. The diffuser 50 receives a flow of compressed air from the centrifugal compressor 52 and diffuses the flow prior to the flow entering a combustor (not shown) of a gas turbine engine. In some embodiments the diffuser 50 can be used to diffuse a flow of liquid or liquid vapor. Such a diffuser can be utilized in some embodiments within a gas turbine engine which is useful to provide power for an aircraft. In some embodiments, the centrifugal compressor can be replaced by other types of compressors.

The term aircraft includes, but is not limited to, helicopters, airplanes, unmanned space vehicles, fixed wing vehicles, variable wing vehicles, rotary wing vehicles, hover crafts, vehicles, and others. Further, the present inventions are contemplated for utilization in other applications that may not be coupled with an aircraft such as, for example, industrial applications, power generation, pumping sets, naval propulsion and other applications known to one of ordinary skill in the art.

The vaneless space 54 is a symmetric space disposed between the outer circumference of the centrifugal compressor 52 and the inner portion 56 of the diffuser 50. The vaneless space 54 is offset a constant distance 58 between the compressor 52 and diffuser 50 and can have any variety of magnitudes. In some embodiments, the vaneless space 54 may not be symmetric and the distance 58 may not be constant. In some embodiments the distance 58 can be relatively large while in other embodiments the distance 58 can be relatively small. Though the vaneless space 54 contains no vanes to influence a flow of compressed air coming from the compressor 52, some embodiments may include vanes. Any number of vanes can be used and may be arranged in a variety of patterns.

The diffuser 50 includes numerous diffuser channels 60 at least partially defined by diffuser sidewalls 62. Any number of sidewalls 62 can be used to construct the diffuser 50. Though the diffuser 50 is depicted in the top view of the illustrative embodiment as symmetric, some embodiments can include a nonsymmetric diffuser. For example, a portion of the diffuser can include sidewalls 62 defined as discussed hereinabove, while another portion of the diffuser can have sidewalls defined using other techniques. In one form, each of the diffuser channels 60 has a width 64 that is the same in all of the different channels 60, however in another form the width 64 can be different between at least two of the channels 60. The width 64 can be referred to as the interwall distance. The width 64 is substantially constant along the length 66 of the channel 60, but can also vary along some portion of the length 66 in some embodiments. The length 66 is measured along the sidewall 62 from a starting point 68 to an ending point 70, and though the length 66 is depicted as the same across all diffuser sidewalls 62, some embodiments can have sidewalls 62 with different lengths 66.

The diffuser sidewalls 62 are defined by an involute of a circle that spirals out from a starting circle 72 and which, as discussed above, can be described by a set of parametric Cartesian equations. Other mathematical expressions can also be used to describe the involute. Some embodiments can contain sidewalls 62 that follow a path that is an approximation to the involute of a circle described above. In other embodiments, a portion of the sidewall 62 along its length 66 may not be defined by the involute of a circle. In one nonlimiting example, the first portion of the length 66 can be defined by the involute while the remaining portion can be defined by another shape, such as a straight line to set forth just one nonlimiting embodiment. In yet another example, some embodiments may have a sidewall 62 initially defined by the involutes while the remaining portion can have a piecewise continuous shape that may, or may not, resemble a spiral.

The involute of a circle that defines at least part of the sidewall 62 is developed within a plane of construction which is parallel to the two-dimensional plane on which the illustrative embodiment is depicted in FIG. 1. The involute of a circle begins at the starting point 68 on the starting circle 72 which has a center 74 and a radius 76. Each involute of a circle that defines the sidewall 62 begins at evenly spaced starting points 68. In some embodiments, however, the involutes of a circle that define the sidewall 62 need not start at evenly spaced starting points 68. For example, some involutes can be spaced closer together than others. As discussed above, one property of the involutes of a circle provides for a constant width 64 between sidewalls that are defined relative to the same starting circle, while another property also provides that a line drawn tangent to the starting circle will intersect successive involutes at right angles. Any number of involutes can be used to define any number of sidewalls 62 in the diffuser 50.

Figure 2:
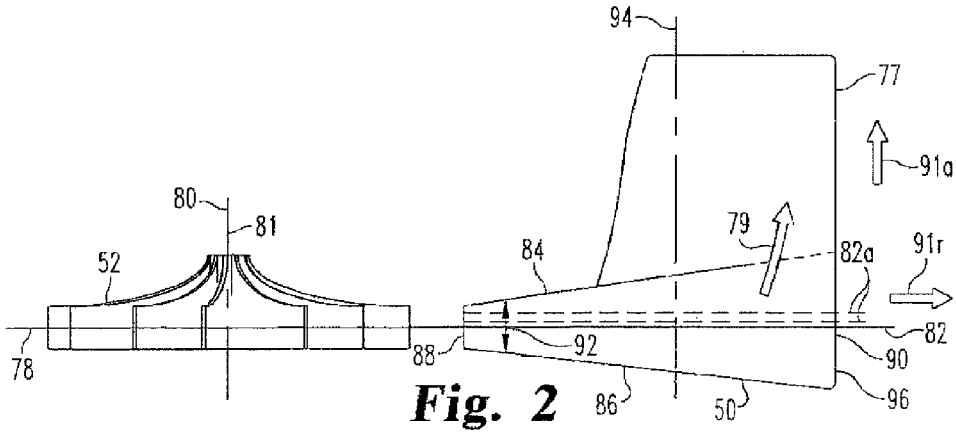
FIG. 2 is a partial side view of a compressor and diffuser along line 2-2 of FIG. 1.

With reference to FIG. 2, a partial side view of the compressor 52 and diffuser 50 is shown, wherein only one side of the circular diffuser is shown to the right of FIG. 2. Also depicted is a scroll 77 that is configured to receive diffused flow 79 from the diffuser 50. The centrifugal compressor 52 rotates within a plane of rotation 78 and about a rotational axis 80 which is perpendicular to the plane 78. The plane 78 is the same plane as discussed above in FIG. 1.

The diffuser 50 is centered about a central axis 81 which coincides with the rotational axis 80 of the compressor 52, but in some embodiments the central axis 81 can be displaced from the rotational axis 80 and may, or may not, be parallel to the rotational axis 80. The diffuser 50 is arranged along a plane of construction 82 which is parallel to the centrifugal compressor plane of rotation 78. In some embodiments, however, the diffuser plane of construction 82 need not be parallel to the compressor plane of rotation. As will be appreciated, if the diffuser plane of construction 82 is not parallel to the compressor plane of rotation 78, then the central axis 81 will not be parallel to the rotational axis 80.

As seen in the side view in FIG. 2, the diffuser channel has a top wall 84, a bottom wall 86, a diffuser entrance 88, and a diffuser exit 90. To assist the description that follows, the direction from the top wall 84 to the bottom wall 86 is referred to as the axial direction 91*a*. The top wall 84 corresponds to an axial fore wall and the bottom wall to an axial aft wall. In addition, the direction from the diffuser entrance 88 to the diffuser exit 90 is referred to as the radial direction 91*r*. The diffuser entrance 88 corresponds to an inner radial area of the diffuser 50 and the diffuser exit 88 corresponds to an outer radial area. Lastly, and with reference back to FIG. 1, a circumferential direction proceeds around the circumference of the diffuser 50 as depicted by reference numeral 91*c*.

The diffuser sidewalls 62 have a height 92 defined between the top wall 84 and the bottom wall 86. The height 92 varies along the length 66 of the diffuser channel 60 but is substantially constant across the width 64 from one sidewall 62 to another sidewall 62. In some embodiments, however, the height 92 can also vary across the width 64 according to any relationship, whether mathematical, arbitrary, or otherwise. In the illustrative embodiment, the top wall 84 and bottom wall 86 each diverge at an angle of 4 degrees relative to the plane of construction 82. In other embodiments the angle can be anywhere from 0-10 degrees. Furthermore, the angle of divergence can be any value in other embodiments and need not be the same for both top wall 84 and bottom wall 86. In some embodiments, the top wall 84 and bottom wall 86 can be parallel to each other along at least a portion of the length 66 of the diffuser channel 60. Furthermore, in some embodiments one of either the top wall 84 or bottom wall 86 can be parallel to the plane of construction 82. The height 92 can vary in the radial direction 91*r* according to any relationship. For example, the height 92 can vary linearly as shown in the illustrative embodiment, but the height 92 can also vary exponentially, or as a sinusoid, or may be arbitrary, to set forth just three nonlimiting examples. As will be appreciated given the description of directions above and of the properties of involutes of circles, the diffusion of air flowing through the diffuser 50 takes place primarily in the axial direction in the illustrative embodiment. Some alternative embodiments, however, can provide for some diffusion in the circumferential direction 91*c* along at least a portion of the diffuser channel 60. Additionally and/or alternatively, some embodiments can also have portions of the diffuser channel 60 arranged to provide more diffusion in the circumferential direction 91*c* than in the axial direction 91*a*. It will be appreciated, therefore, that arranging a diffuser 50 according to some of the embodiments discussed above can allow tradeoff, if needed, between axial diffusion and circumferential diffusion.

The illustrative embodiment depicts a common top wall 84 and a common bottom wall 86 across all diffuser channels 60. In some embodiments, however, not all channels 60 need have the same top wall 84 and bottom wall 86. In one nonlimiting example, channels 60 identified with a particular portion of the diffuser can have common top walls 84 and bottom walls 86, while the remaining portion or portions have varying top and bottom walls 84, 86. In another embodiment, one region of the diffuser 50 can have common top and bottom walls 84, 86. Other variations are also contemplated herein.

With continuing reference to FIGS. 1 and 2, the sidewalls 62 are constructed as follows. An initial starting circle 72 is defined in the plane of construction 82, and additional starting circles 72 are thereafter defined in additional planes of construction 82*a* that are parallel to the plane of construction 82. In some embodiments, however, not all planes of construction 82 and 82*a* need be parallel. Numerous involutes of a circle are defined in the various additional planes of construction 82*a*, each of which are in line with an involute in an adjacent plane of construction 82 and/or 82*a*, wherein each are arranged along an axis 94 perpendicular to the plane of construction 82. The sidewalls 62 are thus constructed according to the shape defined by the involutes in the plane of construction 82 and all additional planes of construction 82*a*. In some embodiments, a sidewall 62 can be constructed with over half its height 92 defined by successive involutes of a circle, with the remainder of the height 92 defined by other shape(s) altogether. Other proportions are also contemplated herein. It will be appreciated that although an involute can be defined in any given plane of construction 82 and/or 82*a*, that a physical sidewall 62 may not be present. For example, the portion of the diffuser channel 60 located radially outward and axially aft resides in a lower plane of construction 82*a*, but no sidewall 62 is present in the same plane of construction 82*a* in the area located radially inwardly towards the entrance 88.

In some embodiments, the involutes of a circle in any given plane of construction 82 or 82*a* can be rotated circumferentially relative to the involutes in an adjacent plane of construction, which rotation can sometimes be referred to as 'clocked', such that the involutes in an adjacent plane of construction 82 or 82*a* are not in line with an involute in an adjacent plane. Such an embodiment would have involutes in adjacent planes that are not arranged along the axis 94. A shape similar to a helix could be created by clocking the involutes in each successive plane of construction 82*a* by a constant amount. Other shapes are also contemplated.

In other embodiments, the involutes from one plane of construction 82*a* may have a different width 64 between sidewalls 62 than involutes in another plane of construction 82*a*. For example, portions of the sidewalls 62 constructed in an axially aft plane of construction 82*a* can have a smaller width 64 relative to the portions of the sidewalls 62 constructed in an axially fore plane of construction 82*a*. It is also contemplated herein that variations of width 64 between different channels 60 within a given plane of construction 82 or 82*a* can also occur in some embodiments.

The diffuser entrance 88 is shown as perpendicular to the plane of construction 82, but other configurations are also contemplated. Some embodiments can have a chamfered diffuser entrance 88 such that an angle is created between the entrance 88 and the plane of construction 82. In other embodiments, the entrance 88 can be defined by successive planes of construction 82*a* each having starting circles 72 of different radii 76. Such successive starting circles 72 can have radii that vary over the height 92 of the entrance 88, either according to established mathematical relationships (such as a linear variation or piece-wise linear variation to set forth just two nonlimiting examples) or can vary according to another relationship that can be arbitrary or can be dictated by other requirements. In the illustrative embodiment the starting circles 72 in the various planes of construction 82 and 82*a* are all centered about the rotational axis 80, but in other embodiments the starting circles 72 can be centered, either individually or as a group or groups, around a different axis or axes.

The diffuser exit 90 is also shown as perpendicular to the plane of construction 82, but may take on any arbitrary shape. With reference to the side view in FIG. 2, the exit 90 can be oriented at an angle relative to the plane of construction 82, it may be defined by a mathematical relationship, or it could be arbitrary. With reference to the top view in FIG. 1, the diffuser outer perimeter 96, which forms at least part of the diffuser exit 90, can have any variety of forms. The illustrative embodiment in FIG. 1 depicts the outer perimeter 96 as circular with a center that corresponds to center 74 of the starting circle 72. In some embodiments, however, the outer perimeter 96 may not have a center coincident with center 74, but rather may have another center altogether. In addition, the outer perimeter 96 need not be circular. For example, the outer perimeter 96 can have a sinusoidal character or may be any other shape, mathematical, arbitrary, or otherwise. In any given plane of construction 82 or 82*a* the diffuser exit 90 will coincide with the end of the sidewall 62, whether the sidewall 62 is an involute of a circle at that point or not. Thus, the diffuser exit is defined by joining the ending points 70 in each plane of construction 82 and 82*a*.

Figure 3:
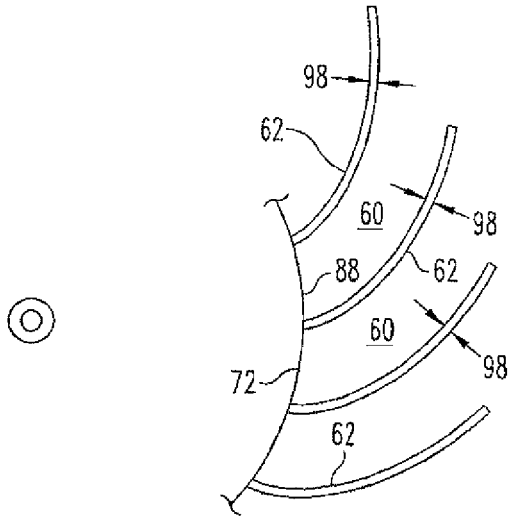
FIG. 3 is a partial top view of a diffuser.

With reference to FIG. 3, a partial top view of the diffuser 50 is shown which depicts the starting circle 72, diffuser entrance 88, and sidewalls 62. The sidewalls can be constructed having a constant thickness 98 along the length 66 of the diffuser channel 60. A sidewall 62 having a constant thickness 98 allows the sidewalls 62 to be made from sheet metal, among other materials. The thickness of the illustrative embodiment is 0.0035 inches and can be made from strip stock. In other forms the thickness can be between 0.010 and 0.020 inches. In still other forms the thickness 98 can be any value. In some embodiments, the sidewalls 62 may not have a substantially constant thickness 98 along the length 66 of the diffuser channel 60. For example, the thickness 98 can be greater near the entrance 88 than it is near the exit 90.

Figure 4:
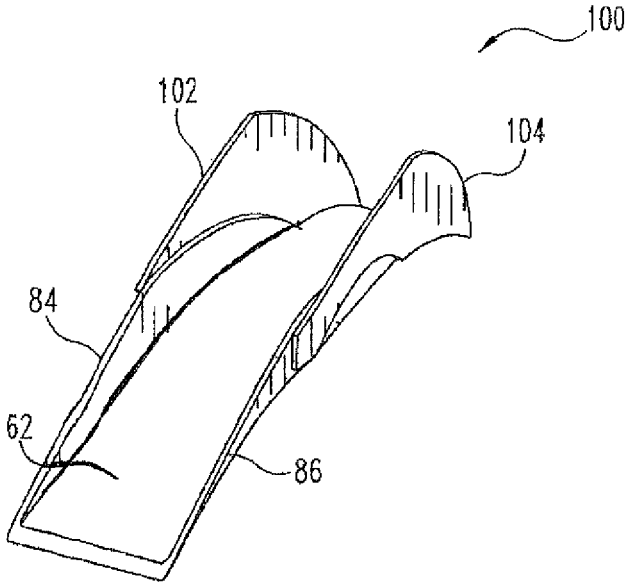
FIG. 4 is a view of one embodiment of a diffuser portion of the present application.
Figure 5:
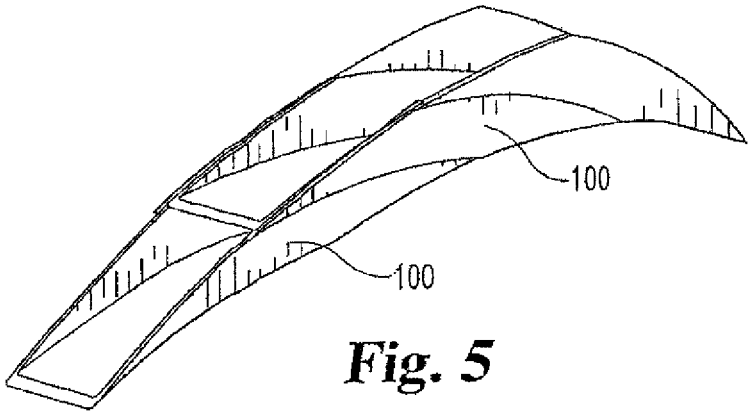
FIG. 5 is a view of one embodiment of two diffuser portions of the present application coupled together in a nesting relationship.
Figure 6:
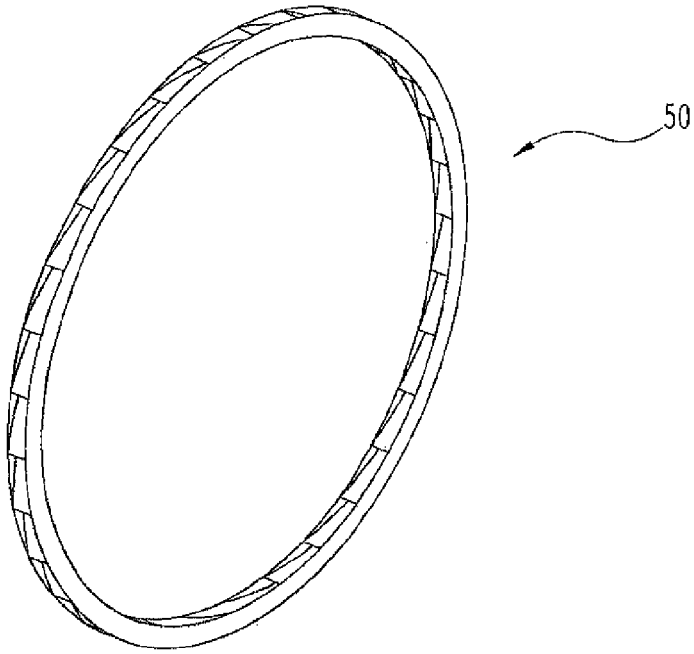
FIG. 6 is a view of one embodiment of an annular assembly of multiple diffuser portions forming a diffuser of the present application.
Figure 7:
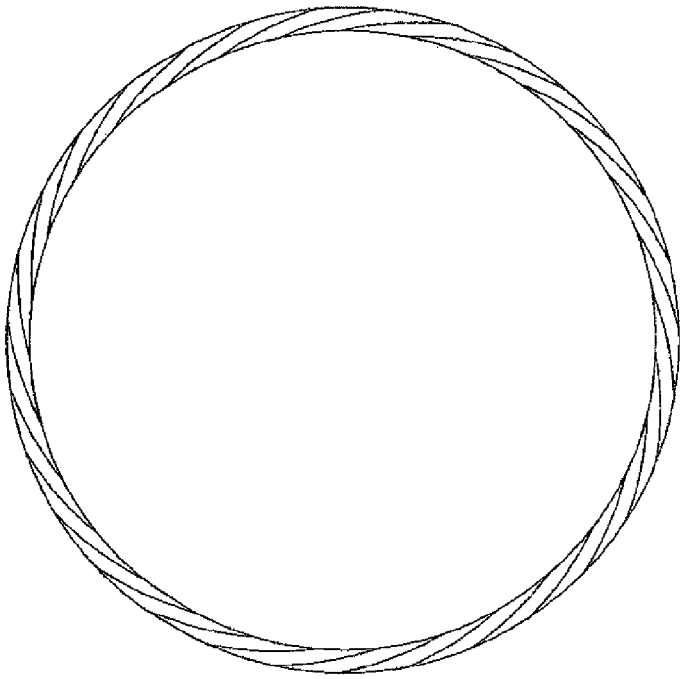
FIG. 7 is a side view of the diffuser embodiment shown in FIG. 6.

Turning now to FIGS. 4-7, one embodiment of the diffuser 50 is shown in various stages of construction. FIG. 4 depicts a diffuser portion 100 having a sidewall 62, and walls 84 and 86. Coupling members 102 and 104 are used to connect the diffuser portion 100 to another diffuser portion 100. In one form the diffuser portion 100 can be produced in a die. The arrangement of the various elements depicted in FIG. 4 can be made in one non-limiting form through a sheet metal stamping operation. FIG. 5 depicts two diffuser portions 100 coupled together in a nesting relationship where portions of either or both the walls 84 and 86 and coupling members 102 and 104 of both diffuser portions 100 are contactingly received with each other. In some forms not all of the walls 84 and 86 and coupling members 102 and 104 need be contactingly received by a corresponding diffuser portion 100. FIG. 6 depicts an annular assembly of diffuser portions 100 forming the diffuser 50. In one form the annular assembly can be a brazed assembly of individual diffuser portions. Other manufacturing techniques capable of joining the diffuser portions 100 are also contemplated herein. FIG. 7 is a side view of the diffuser 60 embodiment depicted in FIG. 6.

In one embodiment, there is a gas turbine engine apparatus comprising a diffuser having two sidewalls, each of the two sidewalls at least partially defined by an involute of a circle. An interwall distance between the two sidewalls is substantially constant over at least a portion of the length of the two sidewalls.

In another embodiment, there is an apparatus comprising a gas turbine engine compressor diffuser channel defined by a set of walls having a height and an interwall distance. The height increases along the length of the gas turbine engine compressor diffuser channel. A fluid diffusion caused by the height is greater than a fluid diffusion caused by the interwall distance.

In yet another embodiment, there is an apparatus comprising a diffuser channel having an axial diffusion and a circumferential diffusion. The axial diffusion provides a greater diffusion than the circumferential diffusion.

In a further embodiment, there is a method comprising constructing a diffuser wall at least partially defined by an involute of a circle.

One aspect of the present application provides a gas turbine engine apparatus comprising a diffuser structured to receive a working fluid from a gas turbine engine centrifugal compressor, the diffuser having two sidewalls, each of the two sidewalls at least partially defined by an involute of a circle, wherein an interwall distance between the two sidewalls is substantially constant over at least a portion of the length of the two sidewalls.

Another aspect of the present application provides an apparatus comprising a gas turbine engine compressor diffuser channel defined by a set of walls having a height and an interwall distance, wherein the height increases along the length of the gas turbine engine compressor diffuser channel and wherein a fluid diffusion caused by the height is greater than a fluid diffusion caused by the interwall distance.

Yet another aspect of the present application provides an apparatus comprising a gas turbine diffuser channel having an axial diffusion and a circumferential diffusion, wherein the axial diffusion provides a greater diffusion than the circumferential diffusion.

Still a further aspect of the present application provides a method comprising constructing a diffuser wall at least partially defined by an involute of a circle.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A gas turbine engine apparatus comprising:

a diffuser structured to receive a working fluid from a gas turbine engine centrifugal compressor, the diffuser having two sidewalls, each of the two sidewalls at least partially defined by an involute of a circle, wherein an interwall distance between the two sidewalls is substantially constant over at least a portion of the length of the two sidewalls;

wherein the diffuser includes a plurality of separately formed diffuser portions coupled together in a manufacturing process that produces a substantially annular construction of the separately formed diffuser portions; and wherein the separately formed diffuser portions include a sidewall and a first and second wall and are constructed from sheet metal using a die.

2. The apparatus of claim 1 wherein the diffuser further includes a plurality of the sidewalls evenly spaced around a starting circle.

3. The apparatus of claim 1 wherein the relative orientation of the first wall to the second wall provides for an increase in cross-sectional area along the length of a channel defined by the first wall, the second wall, and the two sidewalls.

4. The apparatus of claim 1 wherein the two sidewalls each have a height and a length, wherein the height of each sidewall increases along the length of each sidewall.

5. The apparatus of claim 1 wherein the involutes of a circle for each of the sidewalls are defined relative to a plane of construction, the sidewalls each including an offset involute of a circle defined relative to an offset plane of construction, wherein the offset plane of construction is parallel to the plane of construction.

6. The apparatus of claim 1 wherein the manufacturing process produces a brazed construction of the separately formed diffuser portions.

7. An apparatus comprising:

a gas turbine engine compressor diffuser channel defined by a set of walls having a height and an interwall distance, wherein the height increases along the length of the gas turbine engine compressor diffuser channel and wherein a fluid diffusion caused by the height is greater than a fluid diffusion caused by the interwall distance, which further includes the gas turbine engine having a centrifugal compressor positioned upstream of the gas turbine engine compressor diffuser channel, a vaneless space disposed between the centrifugal compressor and the gas turbine engine compressor diffuser channel, which further includes a plurality of gas turbine engine compressor diffuser channels arranged to form a diffuser, wherein the plurality of gas turbine engine compressor diffuser channels is constructed relative to a diffuser plane of construction, and wherein the plurality of gas turbine engine compressor diffuser channels form an annular diffuser constructed from a plurality of components each having at least one channel wall and two opposing sidewalls.

8. The apparatus of claim 7 wherein the set of walls is substantially defined by an involute of a circle.

9. The apparatus of claim 7 wherein the height increases linearly with distance along the length of the gas turbine engine compressor diffuser channel at an angle of between 0 and 10 degrees relative to a plane defined perpendicular to the sidewalls.

10. The apparatus of claim 7 wherein the walls are made of sheet metal.

11. The apparatus of claim 7 wherein the plurality of components are stamped sheet metal and the annular diffuser is a brazed construction of the plurality of components.

12. The apparatus of claim 7 which further includes a scroll positioned downstream of the gas turbine engine compressor diffuser channel.

13. An apparatus comprising:

a gas turbine diffuser having an axial fluid diffusion and a circumferential fluid diffusion, wherein the axial fluid diffusion provides a greater fluid diffusion than the circumferential fluid diffusion, wherein the diffuser includes a plurality of separately formed diffuser portions constructed from sheet metal using a die and each having a plurality of walls that includes a sidewall from which an upstanding wall extends, the sidewall growing in height across its length to provide the axial diffusion, the plurality of separately formed diffuser portions coupled together in a manufacturing process that produces a substantially annular construction of the separately formed diffuser portions.

14. A method comprising:

constructing a gas turbine engine diffuser wall portion having a sidewall that is at least partially defined by an involute of a circle, the diffuser wall portion also having an upstanding wall that extends from the sidewall, the sidewall growing in height along its length to provide a fluid diffusion, the constructing including:

providing a stock material for forming the diffuser wall portion; and deforming a portion of the stock material to form the upstanding wall and to form the sidewall that is at least partially defined by an involute of a circle.

15. The method of claim 14 further comprising creating a diffuser channel having a top and bottom wall and a first diffuser wall and a second diffuser wall by coupling a first diffuser wall portion and a second diffuser wall portion after the providing the stock material and the deforming the stock material to produce the first and second diffuser wall portions.

16. The method of claim 15 further comprising expanding the cross sectional area of the diffuser channel by increasing the distance between the top and bottom wall along the length of the diffuser channel.

17. The method of claim 16 wherein the top wall diverges at an angle relative to a plane of construction of the diffuser wall.

18. The method of claim 14 wherein the constructing includes forming a diffuser channel portion including a diffuser wall, a top wall, and a bottom wall using a die.

19. The method of claim 18 wherein the forming further includes creating a coupling member extending from the top wall.

20. The method of claim 19 which further includes nesting a first diffuser channel portion and a second diffuser channel portion.

21. The method of claim 19 which further includes brazing a plurality of diffuser channel portions together to form a gas turbine engine compressor diffuser.

* * * * *